US009219331B1

(12) United States Patent
Liao

(10) Patent No.: US 9,219,331 B1
(45) Date of Patent: Dec. 22, 2015

(54) CABLE CONNECTOR

(71) Applicant: WELL SHIN TECHNOLOGY CO., LTD., Taipei (TW)
(72) Inventor: Hui Ren Liao, Taipei (TW)
(73) Assignee: WELL SHIN TECHNOLOGY CO., LTD., Taipei (TW)

( * ) Notice: Subject to any disclaimer, the term of this patent is extended or adjusted under 35 U.S.C. 154(b) by 0 days.
(21) Appl. No.: 14/516,969
(22) Filed: Oct. 17, 2014
(30) Foreign Application Priority Data

Aug. 12, 2014 (TW) ..... 103214374 U

(51) Int. Cl.
*H01R 13/58* (2006.01)
*H01R 13/621* (2006.01)
*H01R 24/28* (2011.01)

(52) U.S. Cl.
CPC ..... *H01R 13/621* (2013.01); *H01R 24/28* (2013.01)

(58) Field of Classification Search
CPC ..... H01R 13/621; H01R 24/28
USPC ..... 439/470, 472, 695, 701, 352, 696, 455, 439/465
See application file for complete search history.

(56) References Cited

U.S. PATENT DOCUMENTS 4,108,527 A * 8/1978 Douty ..... H01R 13/5825 439/465
4,319,799 A * 3/1982 Pearce, Jr. ..... H01R 13/436 439/689
4,449,776 A * 5/1984 Carmo ..... H01R 13/6271 439/350
5,236,375 A * 8/1993 Kachlic ..... H01R 13/6275 439/607.13
5,344,347 A * 9/1994 Inoue ..... H01R 13/193 439/701
6,568,954 B2 * 5/2003 Endo ..... H01R 13/641 439/352
7,074,071 B2 * 7/2006 Bernat ..... H01R 4/2433 439/409
7,871,288 B1 * 1/2011 Lee ..... H01R 9/03 439/470
8,182,297 B2 * 5/2012 Lin ..... H01R 13/514 439/357
8,656,575 B1 * 2/2014 Bulow ..... H01R 13/622 29/525.01
8,672,705 B2 * 3/2014 Schneider ..... G02B 6/3887 439/460
2001/0031584 A1 * 10/2001 Claus ..... H01R 13/405 439/695
2002/0009932 A1 * 1/2002 Inaba ..... H01R 13/501 439/701
2004/0102082 A1 * 5/2004 Tsuji ..... H01R 13/562 439/470
2005/0003698 A1 * 1/2005 Hata ..... H02G 3/0691 439/470
2008/0032544 A1 * 2/2008 Tsuji ..... H01R 13/506 439/470
2011/0117770 A1 * 5/2011 Lindkamp ..... H01R 13/506 439/470
2011/0212645 A1 * 9/2011 Osawa ..... H01R 13/502 439/352
2011/0269332 A1 * 11/2011 Kim ..... H01R 13/6392 439/470
2013/0072055 A1 * 3/2013 Pedruzzi ..... H01R 13/5829 439/470
2014/0377981 A1 * 12/2014 Gao ..... H01R 13/5812 439/472
2015/0111406 A1 * 4/2015 Okano ..... H01R 13/6272 439/352

* cited by examiner

*Primary Examiner* — Abdullah Riyami
*Assistant Examiner* — Nelson R Burgos-Guntin
(74) *Attorney, Agent, or Firm* — LIN & ASSOCIATES INTELLECTUAL PROPERTY, INC.

(57) ABSTRACT

A cable connector includes an insulating housing, at least one conductive terminal disposed in the insulating housing, and a locking mechanism. The insulating housing includes a rear housing and a substantially barrel-shaped front housing. A periphery of a rear end of the front housing and the periphery of a front surface of the rear housing are connected with a connecting wall. The connecting wall defines at least one insertion groove. The locking mechanism includes a sleeve element and a feed assembly. The sleeve element is capable of moving forward and rearward along the rear housing. The feed assembly is disposed to a rear end of the rear housing. The feed assembly is connected to the sleeve element for controlling the sleeve element to move forward and rearward along the rear housing.

10 Claims, 4 Drawing Sheets

CABLE CONNECTOR

CROSS-REFERENCE TO RELATED APPLICATION

The present application is based on, and claims priority form, Taiwan Patent Application No. 103214374, filed Aug. 12, 2014, the disclosure of which is hereby incorporated by reference herein in its entirety.

BACKGROUND OF THE INVENTION

1. Field of the Invention

The present invention generally relates to a cable connector, and more particularly to a cable connector having a locking mechanism.

2. The Related Art

In general, an electronic device and a power supply are connected by a cable to realize an electrical connection therebetween. One end of the cable is connected with a cable connector. The cable connector is adapted for being electrically connected with a mating connector which is assembled to the electronic device so as to provide power supply input for the electronic device. For example, an IEC C14 connector is connected with an IEC C13 connector for providing the power supply input.

Usually, many electronic devices are used for processing some important work by a user. In the process of operating the electronic device, if the cable connector is caused to loosen or fall off on account of being accidentally touched by a person, that will make the electronic device stop working to bring an inconvenience for a user, so it can be seen that a lot of mating connectors and cable connectors having locking mechanisms sold on market. The function of the locking mechanism is to make the cable connector be connected with the mating connector firmly, even there is no way of disconnecting the cable connector from the mating connector without unlocking the locking mechanism. Thereby, it can prevent the cable connector from loosening or falling off in the process of the electronic device working.

However, if some electronic devices together with the cables are disposed to moving lines of the persons walking around or cargoes handling, and the cable connectors connecting the cables with the electronic devices have the locking mechanisms sold on market, when the persons or the cargoes are accidentally stumbled by the cables, it is possible to cause the persons to be hurt or the cargoes to be damaged. Furthermore, the electronic devices are easily damaged on account of the tug of the cables, and even there is a higher loss on account of the locking mechanisms of the cable connectors.

So in view of the above-mentioned circumstance, it's in urgent need of a cable connector which is difficult to loosen or fall off from the mating connector in the process of the electronic device working, and is also able to be disconnected from the mating connector when the cable is tugged.

SUMMARY OF THE INVENTION

An object of the present invention is to provide a cable connector adapted for being electrically connected with a mating connector. The cable connector includes an insulating housing, at least one conductive terminal and a locking mechanism. The insulating housing includes a hollow rear housing and a substantially barrel-shaped front housing. The front housing is protruded forward from a periphery of a front surface of the rear housing and further is spread outward to project beyond an outer surface of the rear housing. A substantially barrel-shaped receiving space is formed in the front housing for receiving the mating connector. A periphery of a rear end of the front housing and the periphery of the front surface of the rear housing are connected with a connecting wall. The connecting wall defines at least one insertion groove which is communicated between the receiving space and an outside of the front housing. The conductive terminal is disposed in the insulating housing. A rear end of the conductive terminal is located in the rear housing and a front end of the conductive terminal projects into the front housing. The locking mechanism includes a sleeve element and a feed assembly. The sleeve element is capable of moving forward and rearward along the rear housing. The feed assembly is disposed to a rear end of the rear housing and is partially located inside the rear housing. The sleeve element defines at least one cantilever arm which is inserted into the insertion groove along the outer surface of the rear housing and further projects into the receiving space of the front housing. The feed assembly is connected to the sleeve element for controlling the sleeve element to move forward and rearward along the rear housing.

As described above, the cable connector is fastened to the mating connector by virtue of increasing the insertion and withdrawal forces between the cable connector and the mating connector so as to ensure it's difficult for the cable connector to loosen or fall off from the mating connector in the process of the electronic device working. When persons or cargoes are accidentally stumbled by the cable, it's able to disconnect the cable connector from the mating connector on account of a wedging portion being pressed between an inner surface of the front housing and the mating connector, at the moment, when the cable is tugged, the cable connector is also able to fall off in time without the electronic device being pulled down. Thus, the electronic devices are never damaged, and there is a lower loss on account of the locking mechanism of the cable connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
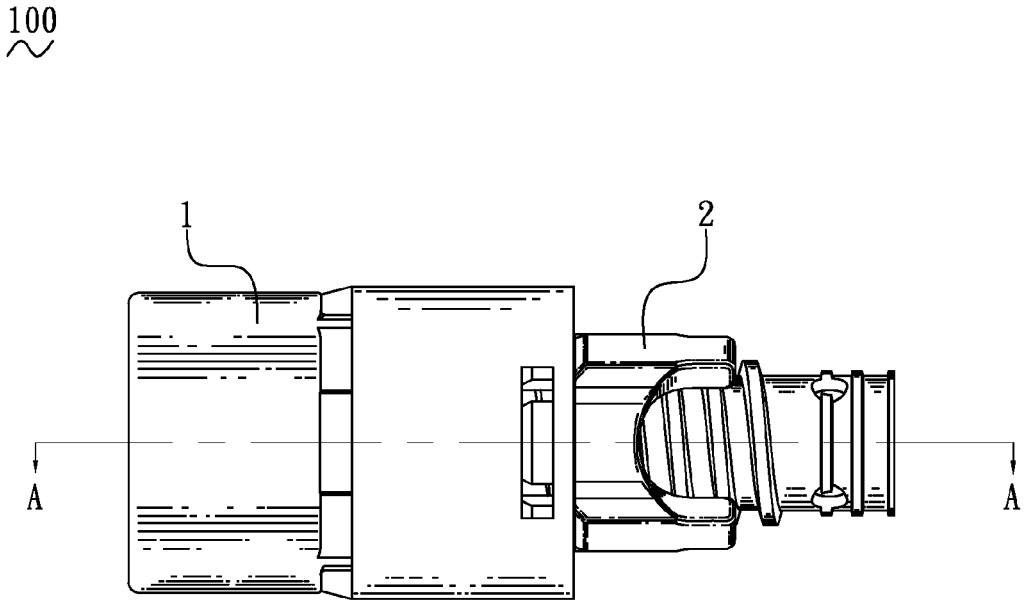
FIG. 1 is a plan view of a cable connector in accordance with an embodiment of the present invention.
Figure 2:
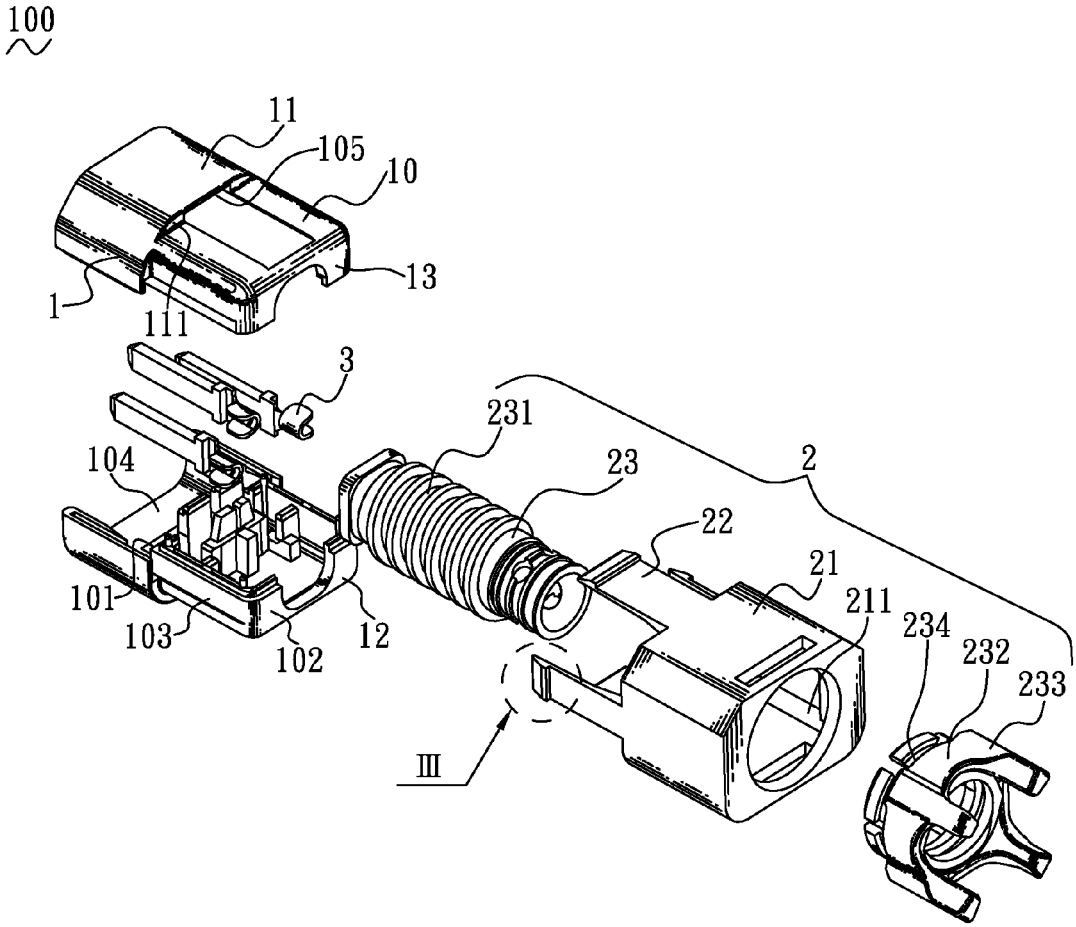
FIG. 2 is an exploded view of the cable connector of FIG. 1.

Referring to FIG. 1 and FIG. 2, a cable connector 100 in accordance with an embodiment of the present invention is shown. The cable connector 100 adapted for being electrically connected with a mating connector (not shown), includes an insulating housing 1, a locking mechanism 2 and at least one conductive terminal 3. The locking mechanism 2 is connected with the insulating housing 1 for increasing insertion and withdrawal forces between the cable connector 100 and the mating connector.

Referring to FIG. 1 and FIG. 2, the insulating housing 1 includes a hollow rear housing 10 and a substantially barrel-shaped front housing 11. A front end and a rear end of the rear housing 10 are opened freely. A front end and a rear end of the front housing 11 are opened freely. The rear housing 10 has a front surface 101, a rear surface 102 opposite to the front surface 101, and an outer surface 103 connected between the front surface 101 and the rear surface 102. In this embodiment, the insulating housing 1 is formed by a lower cover 12, and an upper cover 13 covered on the lower cover 12. A rear end of the lower cover 12 is covered on a rear end of the upper cover 13 to form the rear housing 10, and a front end of the lower cover 12 is covered on a front end of the upper cover 13 to form the front housing 11.

Figure 4:
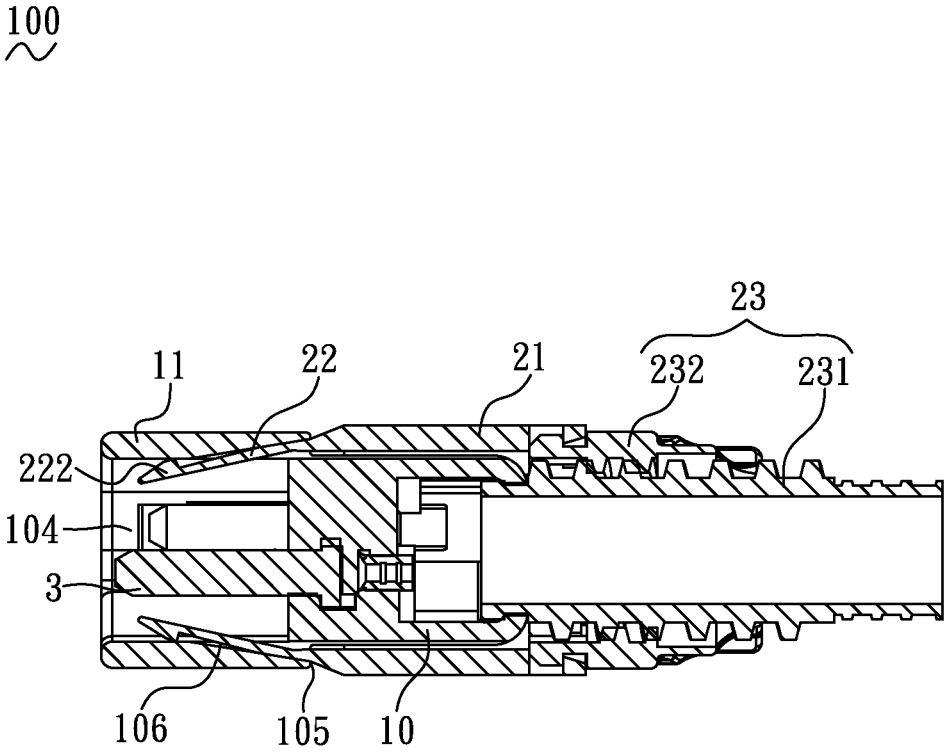
FIG. 4 is a sectional view of the cable connector along a line A-A of FIG. 1.

Referring to FIG. 2 and FIG. 4, the front housing 11 is connected with a periphery of the front surface 101 of the rear housing 10. The front housing 11 is protruded forward from the periphery of the front surface 101 of the rear housing 10 and further is spread outward to project beyond the outer surface 103 of the rear housing 10. A substantially barrel-shaped receiving space 104 is formed in the front housing 11 for receiving the mating connector. The receiving space 104 is communicated with an inside of the rear housing 10. A periphery of the rear end of the front housing 11 and the periphery of the front surface 101 of the rear housing 10 are connected with a connecting wall 111. The connecting wall 111 defines at least one insertion groove 105 which is communicated between the receiving space 104 and an outside of the front housing 11. A rear end of an inner surface of the front housing 11 is inclined outward and rearward to define at least one guiding surface 106 adjacent to the insertion groove 105.

Referring to FIG. 1, FIG. 2 and FIG. 4, the mating connector is in clearance fit with the front housing 11 of the insulating housing 1. The mating connector is spaced from a ring-shaped inner surface of the front housing 11 of the insulating housing 1 to form a ring-shaped gap (not shown) between the mating connector and the inner surface of the front housing 11.

Referring to FIG. 2, the conductive terminal 3 is disposed in the insulating housing 1. A rear end of the conductive terminal 3 is located in the rear housing 10 and a front end of the conductive terminal 3 projects into the front housing 11. When the mating connector is inserted into the front housing 11 of the cable connector 100, the conductive terminal 3 of the cable connector 100 is electrically connected with the mating terminal of the mating connector.

Referring to FIG. 2 and FIG. 4, the locking mechanism 2 includes a sleeve element 21 and a feed assembly 23. The sleeve element 21 of a substantially ring shape is sleeved around the outer surface 103 of the rear housing 10 and is capable of moving forward and rearward along the rear housing 10. The sleeve element 21 defines at least one sheet cantilever arm 22. The cantilever arm 22 is connected to a front end of the sleeve element 21, and is protruded forward from the front end of the sleeve element 21. The sleeve element 21 is of a substantially ring shape. A rear end of the sleeve element 21 defines a circular opening 211 longitudinally penetrating through a middle thereof. The sleeve element 21 is sleeved around the outer surface 103 of the rear housing 10. The cantilever arm 22 is inserted into the insertion groove 105 along the outer surface 103 of the rear housing 10 and further projects into the receiving space 104 of the front housing 11. The cantilever arm 22 is capable of slantwise moving towards a centre axis of the front housing 11 under the guidance of the guiding surface 106 for increasing the insertion and withdrawal forces. The feed assembly 23 is disposed to the rear end of the rear housing 10 and is partially located inside the rear housing 10. The feed assembly 23 is connected to the sleeve element 21 for controlling the sleeve element 21 to move forward and rearward along the rear housing 10.

Referring to FIG. 2, the feed assembly 23 includes a screw rod 231 disposed behind the rear surface 102 of the rear housing 10, and an adjusting nut 232 screwed with the screw rod 231. The adjusting nut 232 defines a plurality of abutting portions 233 protruded outward and then extended rearward from an outer face of the adjusting nut 232 to facilitate rotating the adjusting nut 232 by a finger. A front end of the adjusting nut 232 defines a ring-shaped clamping groove 234. An axial direction of the screw rod 231 is perpendicular to the rear surface 102 of the rear housing 10. The front end of the adjusting nut 232 is rotatably connected to the rear end of the sleeve element 21 in an axial direction through the opening 211. An inner side of a sidewall of the opening 211 is clamped in the clamping groove 234. Thereby, it's capable of controlling the sleeve element 21 to move forward and rearward along the rear housing 10 through rotating the adjusting nut 232.

Referring to FIG. 2, in this embodiment, the abutting portions 233 are ribs and are arranged at intervals for increasing friction forces between the abutting portions 233 and the finger at the time of the finger rotating the adjusting nut 232.

Figure 3:
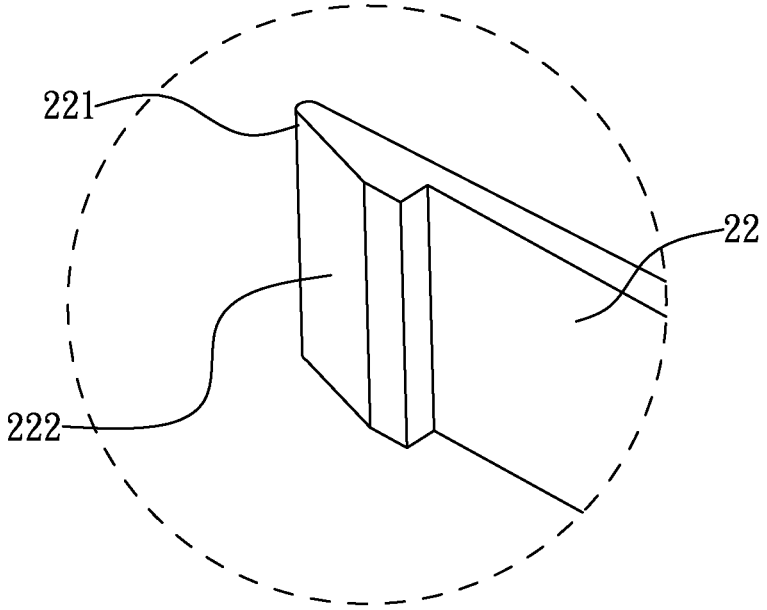
FIG. 3 is an enlarged view of an encircled portion III of the cable connector of FIG. 2.

Referring to FIG. 2 and FIG. 3, a tail end 221 of the cantilever arm 22 is a chamfer or a fillet. One side of the cantilever arm 22 protrudes outward to form a wedging portion 222. A rear end of the wedging portion 222 is thicker than a front end of the wedging portion 222. The wedging portion 222 is able to be formed in an inner side or an outer side of the cantilever arm 22.

Referring to FIG. 1 and FIG. 4, in use, after the cable connector 100 is inserted into the mating connector, it's capable of rotating the adjusting nut 232 to move forward so as to bring along the sleeve element 21 together with the cantilever arm 22 to move forward to make the cantilever arm 22 be inserted into the gap between the mating connector and the ring-shaped inner surface of the front housing 11 for increasing the insertion and withdrawal forces between the front housing 11 of the cable connector 100 and the mating connector.

Referring to FIG. 2, FIG. 3 and FIG. 4, the guiding surface 106 provides a support of the cantilever arm 22 slantwise moving towards the centre axis of the front housing 11. In the process of the cantilever arm 22 being inserted into the gap, because the wedging portion 222 is pressed between the inner surface of the front housing 11 and the mating connector, when the cantilever arm 22 moves forward to be inserted into the gap more deeply, a pressing force between the inner surface of the front housing 11 and the mating connector exerted on the wedging portion 222 is larger, and accordingly, the insertion and withdrawal forces between the front housing 11 of the cable connector 100 and the mating connector are larger. Thereby, the insertion and withdrawal forces between the front housing 11 of the cable connector 100 and the mating connector are determined on moving positions of the cantilever arm 22 to make the insertion and withdrawal forces between the front housing 11 of the cable connector 100 and the mating connector be able to be adjusted.

Referring to FIG. 1 and FIG. 4, the cable connector 100 is connected with one end of a cable (not shown). The mating connector is assembled to an electronic device (not shown), and is connected with the cable connector 100. The electronic device is electrically connected with a power supply (not shown) by the cable. The cable connector 100 is fastened to the mating connector by virtue of increasing the insertion and withdrawal forces between the cable connector 100 and the mating connector so as to ensure it is difficult for the cable connector 100 to loosen or fall off from the mating connector in the process of the electronic device working. When the cable is tugged, it's still able to disconnect the cable connector 100 from the mating connector on account of the wedging portion 222 being pressed between the inner surface of the front housing 11 and the mating connector. The insertion and withdrawal forces are able to be adjusted according to a weight of the electronic device which is connected with the cable connector 100 and because a magnitude of a force of the electronic device being pulled down being related to the weight of the electronic device, if the electronic device is heavier, the insertion and withdrawal forces are able to be adjusted to be larger, and if the electronic device is lighter, the insertion and withdrawal forces are able to be adjusted to be smaller. When persons or cargoes are accidentally stumbled by the cable, it's able to disconnect the cable connector 100 from the mating connector on account of the wedging portion 222 being pressed between the inner surface of the front housing 11 and the mating connector, at the moment, when the cable is tugged, the cable connector 100 is also able to fall off in time without the electronic device being pulled down to be damaged.

As described above, the cable connector 100 is fastened to the mating connector by virtue of increasing the insertion and withdrawal forces between the cable connector 100 and the mating connector so as to ensure it's difficult for the cable connector 100 to loosen or fall off from the mating connector in the process of the electronic device working. When persons or cargoes are accidentally stumbled by the cable, it's able to disconnect the cable connector 100 from the mating connector on account of the wedging portion 222 being pressed between the inner surface of the front housing 11 and the mating connector, at the moment, when the cable is tugged, the cable connector 100 is also able to fall off in time without the electronic device being pulled down. Thus, the electronic devices are never damaged, and there is a lower loss on account of the locking mechanism of the cable connector.

What is claimed is:

1. A cable connector adapted for being electrically connected with a mating connector, comprising:

an insulating housing including a hollow rear housing and a substantially barrel-shaped front housing, the front housing being protruded forward from a periphery of a front surface of the rear housing and further being spread outward to project beyond an outer surface of the rear housing, a substantially barrel-shaped receiving space being formed in the front housing for receiving the mating connector, a periphery of a rear end of the front housing and the periphery of the front surface of the rear housing being connected with a connecting wall, the connecting wall defining at least one insertion groove which is communicated between the receiving space and an outside of the front housing;

at least one conductive terminal disposed in the insulating housing, a rear end of the conductive terminal being located in the rear housing and a front end of the conductive terminal projecting into the front housing; and a locking mechanism including a sleeve element and a feed assembly, the sleeve element being capable of moving forward and rearward along the rear housing, the feed assembly being disposed to a rear end of the rear housing and being partially located inside the rear housing, the sleeve element defining at least one cantilever arm which is inserted into the insertion groove along the outer surface of the rear housing and further projects into the receiving space of the front housing, the feed assembly being connected to the sleeve element for controlling the sleeve element to move forward and rearward along the rear housing.

2. The cable connector as claimed in claim 1, wherein the sleeve element of a substantially ring shape is sleeved around the outer surface of the rear housing.

3. The cable connector as claimed in claim 2, wherein the feed assembly includes a screw rod disposed behind a rear surface of the rear housing, and an adjusting nut screwed with the screw rod, a front end of the adjusting nut is rotatably connected to a rear end of the sleeve element in an axial direction.

4. The cable connector as claimed in claim 3, wherein the rear end of the sleeve element defines a circular opening longitudinally penetrating through a middle thereof, the front end of the adjusting nut defines a ring-shaped clamping groove, an inner side of a sidewall of the opening is clamped in the clamping groove.

5. The cable connector as claimed in claim 3, wherein the mating connector is spaced from a ring-shaped inner surface of the front housing to form a ring-shaped gap between the mating connector and the inner surface of the front housing, it's capable of rotating the adjusting nut to move forward so as to bring along the sleeve element together with the cantilever arm to move forward to make the cantilever arm be inserted into the gap.

6. The cable connector as claimed in claim 3, wherein the adjusting nut defines a plurality of abutting portions protruded outward and then extended rearward from an outer face of the adjusting nut to facilitate rotating the adjusting nut.

7. The cable connector as claimed in claim 6, wherein the abutting portions are ribs and are arranged at intervals.

8. The cable connector as claimed in claim 1, wherein a rear end of an inner surface of the front housing is inclined outward and rearward to define at least one guiding surface adjacent to the insertion groove, the cantilever arm is capable of slantwise moving towards a centre axis of the front housing under the guidance of the guiding surface for increasing insertion and withdrawal forces.

9. The cable connector as claimed in claim 1, wherein one side of the cantilever arm protrudes outward to form a wedging portion, the wedging portion is pressed between an inner surface of the front housing and the mating connector.

10. The cable connector as claimed in claim 1, wherein a tail end of the cantilever arm is a chamfer or a fillet.

* * * * *